US005222898A

United States Patent [19]

Fedder et al.

[11] Patent Number: 5,222,898

[45] Date of Patent: Jun. 29, 1993

[54] MODULAR CABLE ASSEMBLY

[75] Inventors: James L. Fedder, Etters; Keith S. Koegel, Linglestown, both of Pa.

[73] Assignee: The Whitaker Corporation, Wilmington, Del.

[21] Appl. No.: 955,009

[22] Filed: Oct. 1, 1992

[51] Int. Cl.[5] ..... H01R 13/652

[52] U.S. Cl. ..... 439/101; 439/108

[58] Field of Search ..... 439/101, 108

[56] References Cited

U.S. PATENT DOCUMENTS

| | | | |
|---|---|---|---|
| Re. 26,646 | 8/1969 | Evans | 29/190 |
| Re. 26,837 | 3/1970 | Evans | 361/393 |
| 3,818,424 | 6/1974 | Evans | 439/852 |
| 4,984,992 | 1/1991 | Beamenderfer et al. | 439/108 |

*Primary Examiner*—Gary F. Paumen

[57] ABSTRACT

Cable connectors are provided which include an insulating housing block including at least first and second contact-receiving cavities and at least one transverse opening for communicating between these cavities. The connector also includes an electrical cable assembly having at least two insulated signal wires co-axially protected by a conductive shell and disposed in the first contact-receiving cavity. A reference contact is disposed in the second cable-receiving cavity and includes a contact finger frictionally contacting the conductive shell through the transverse opening between the cavities for providing a reference voltage to, for example, a pin field connector, or the like.

21 Claims, 5 Drawing Sheets

MODULAR CABLE ASSEMBLY

FIELD OF THE INVENTION

This invention is related to modular connector assemblies, and especially, to those assemblies which are capable of housing and grounding differential pair conductors.

BACKGROUND OF THE INVENTION

The telecommunications industry employs many miles of cable for low frequency transmissions. Recent trends in this industry have dictated that signal contacts are designed to be closer together than previously. This shortens the signal transmission pass between signal contacts and reduces the amount of space occupied by the contact spacing. Unfortunately, if the signal contacts are close together, they can be electrically coupled inductively and capacitively to produce cross-talk and stray voltages. One prior art attempt to minimize these effects by separating rows of signal contacts with reference contact plates is described in U.S. Pat. No. 4,984,992, which is incorporated herein by reference.

During an electrical signal transmission, pulses are sent along parallel circuit paths and the magnitude of the differences between these paths is measured in deciphering the signal. Since separately shielded signal wires can be affected somewhat differently by electrical interferences over the many miles of transmission, pulses can be changed beyond allowable tolerance levels.

In an effort to avert the inductive and electrostatic variances between parallel pulse lines of digital switching applications, "differential pair" conductors have been designed which include a pair of connector wires insulated from one another and shielded with a metallic braiding. The ends of the differential pair typically include an adapter connected to the differential pair cable with a braided PIC termination and insulation strain relief. Since both connector wires of the differential pair are identically and commonly insulated and conductively-shielded from electrical interference, they produce the same response to inductive and electrostatic effects, thereby providing an accurate differential magnitude for more reliable signal deciphering.

Because differential pairs are a relatively new connector element, connector housings, and the like, must be equipped to accommodate them in a highly reliable and efficient fashion. Accordingly, a need exists for cable connector systems which provide means for using differential pairs with currently employed low frequency connectors and reference elements for eventually connecting to mating portions on a printed circuit board, such as the posts of a pin field connector. Such systems must both conserve space and minimize noise and cross-talk.

SUMMARY OF THE INVENTION

This invention provides cable connectors and housing blocks suitable for connecting and providing a reference voltage to differential pair conductors. In a first preferred embodiment, the cable connector includes an insulating housing block having at least two cable-receiving cavities disposed through its thickness and at least one transverse opening for communicating between the cavities. Disposed in a first of the cavities is an electrical cable assembly including at least two insulated signal wires and a protective conductive shell or layer co-axially disposed around a portion of the cable assembly. In the second cavity there is disposed a reference contact including a contact finger frictionally positioned in electrical contact with the conductive shell through the transverse opening.

Accordingly, this invention provides means for commonly grounding various contact leads along the conductive shell of the electrical cable assembly. The insulating housing block can be specially equipped with many smaller cable-receiving cavities for interchangeably receiving reference contacts and signal wire contacts, so that a wide variation of connector configurations can be employed without major redesigning. The conductive shells, preferably, wire braiding and/or conductive cans, disposed around the electrical cable assemblies, or differential pair cables, of this invention effectively dissipate static charges from outside of the unit for minimizing stray voltages.

In another preferred embodiment of this invention, a cable connector is provided having an insulating housing block including at least three cable-receiving cavities and at least one transverse opening for communicating between a first and a second of these cavities. In a first cavity of this housing block there is disposed a differential pair cable having at least two insulating wires and including a conductive shell co-axially disposed around a portion of the signal wires and insulated from these wires. A ground contact is disposed in a second cavity which includes a contact finger frictionally contacting the conductive shell for applying a reference voltage, ground, or return voltage to, for example, a post of a pin field connector. This embodiment also includes a signal wire having a mating contact disposed in a third of the cavities of the housing block. Preferably, the signal wire mating contact and the ground contact are approximately sized to frictionally fit interchangeably within the second and third cavities.

BRIEF DESCRIPTION OF THE DRAWINGS

The accompanying drawings illustrate preferred embodiments of the invention according to the practical application of the principles thereof, and in which.

DETAILED DESCRIPTION OF THE INVENTION

Cable connectors and connector housing blocks are provided which provide common grounding between the conductive metal shell of a multiple cable assembly, such as a differential pair electrical cable assembly, and one or more reference contacts suitable for connecting to posts of a pin field connector, or the like. The cable connectors also preferably permit interchangeability between reference contacts and signal contacts, such as low frequency cable contacts, for permitting a myriad of flexible end uses. As used herein, the term "differential pair" comprises at least two signal wires, and may contain from about two to about twelve independent signal wires. The term "shell" used in connection with the electrical cable assemblies and differential pairs refers to any conductive or semi. conductive continuous layer suitable for providing a reference voltage or ground, including braided wire, mesh, metallic films or cans.

Figure 1:
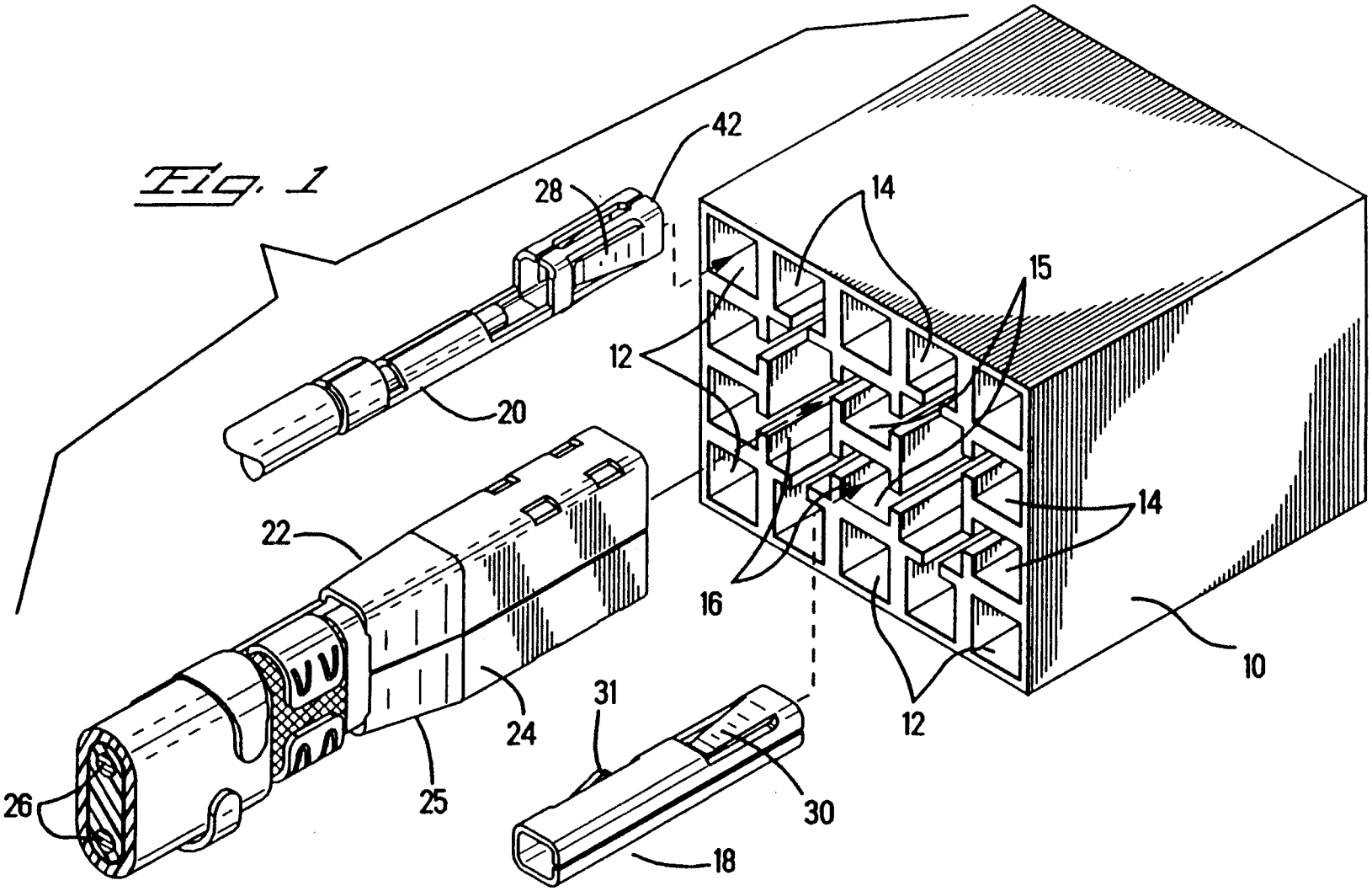
FIG. 1: is an exploded perspective view of a preferred cable connector of this invention including a differential pair electrical cable assembly, a low frequency cable contact, an electrostatic grounding contact, and a 4×5 modular housing block.
Figure 2:
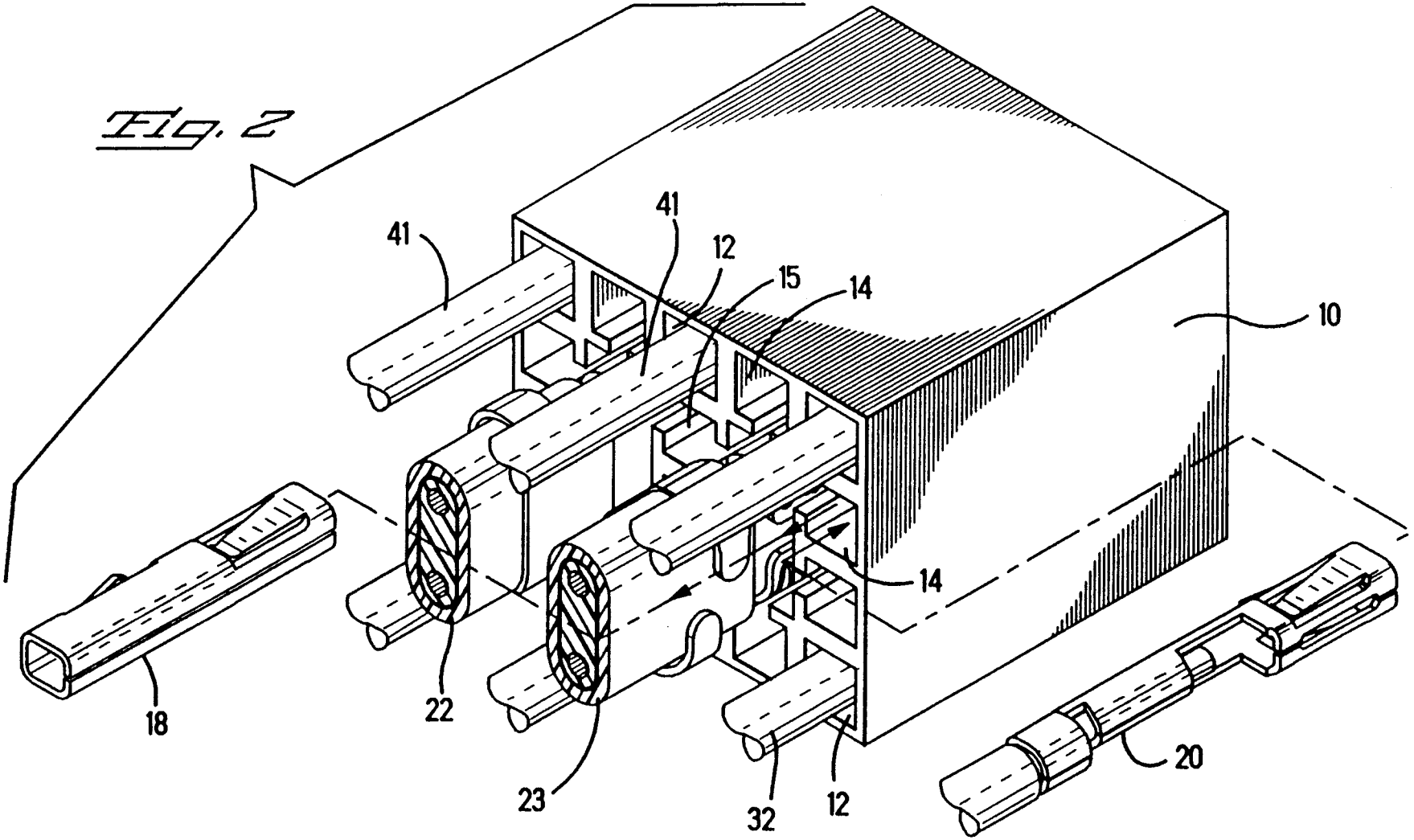
FIG. 2: is a perspective view of the preferred cable connector of this invention including at least six low frequency cables disposed in alternating cavities and a pair of differential pair electrical cable assemblies located in the central cavities of the housing block, also illustrating, in exploded view, alternative low frequency cable and electrostatic discharge grounding contacts for fitting within one of the smaller cable-receiving cavities.

With reference to FIGS. 1–7, a preferred embodiment of the cable connectors of this invention will now be described. The preferred cable connector includes an insulating housing block 10 made of an insulating plastic material, and preferably an insulating plastic material which is injection molded or otherwise formed to provide contact-receiving cavities therethrough. Housing block 10 comprises multiple cable-receiving cavities, including at least one centrally-located cavity for receiving a differential pair electrical cable assembly, and a plurality of smaller cavities having similar cross-sectional areas disposed around the central cavity for preferably alternatingly receiving a low frequency cable contact 20, an electrostatic discharge grounding contact 18, or the like. Preferably, the housing block 10 comprises about 10–50 cavities therethrough, including a preferred arrangement having two larger central cavities 16 adapted to receive differential pair electrical cable assemblies 22 and 23 (FIG. 2). Circumscribed around these larger central cavities is a plurality of smaller cavities, which can include, for example, alternating smaller cavities 12 without a side transition opening, and smaller cavities 14 including at least one transverse opening, such as a longitudinal slot. This embodiment further includes two centrally-located smaller cavities 15 having a pair of transverse openings each for communicating with a larger central cavity 16.

Although a 4×5 modular block is illustrated in the Figures, it is envisioned that any number of configurations would be suitable for the applications of this invention, for example, those normally associated with pin arrays, such as 6×6, 8×10, etc. The housing block 10 includes at least one larger cavity for receiving a central electrical cable having at least two insulated wires, and a second smaller cavity for containing a reference contact which communicates with a conductive shell portion of the cable assembly.

Figure 5:
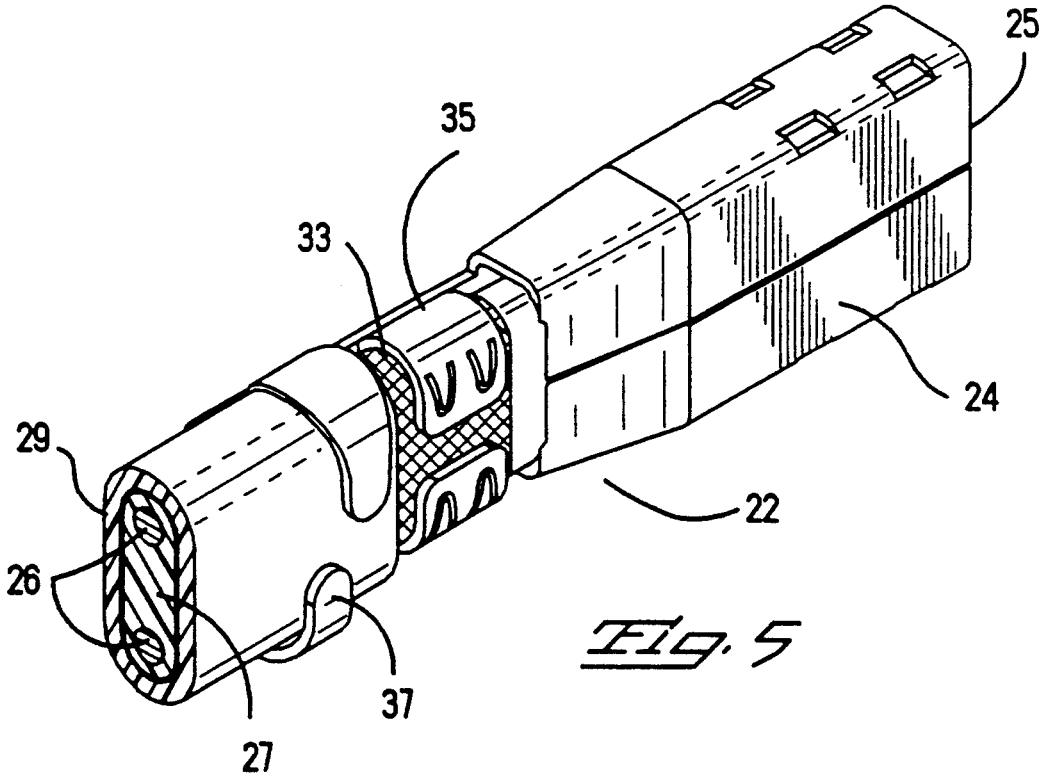
FIG. 5: is a detailed, perspective of the preferred differential pair electrical cable assembly of this invention.

Differential pair cable assemblies 22 have been used in the telecommunications industry for minimizing the effects of cross-talk and stray voltages on the magnitude of the differences between the pulsed charges carried through connector wires. With reference to FIG. 5, such structures typically include a pair of conductor wires 26 insulated with a polymeric insulation composition 27. Disposed co-axially around the insulation portion is a conductive braided strip 33. The braided strip 33 preferably includes a copper or aluminum wire. The differential pair is connected to a plug adapter 25 which is suitable for mounting to a pin connector unit (not shown). The plug adapter 25 includes shielding can 24 and is adhered to the outer insulation layer 29 of the differential pair with insulation strain relief 37 and a braid PIC termination 35, the latter providing electrical connection between the shielding can 24 and the conductive braided strip 33.

Figure 6:
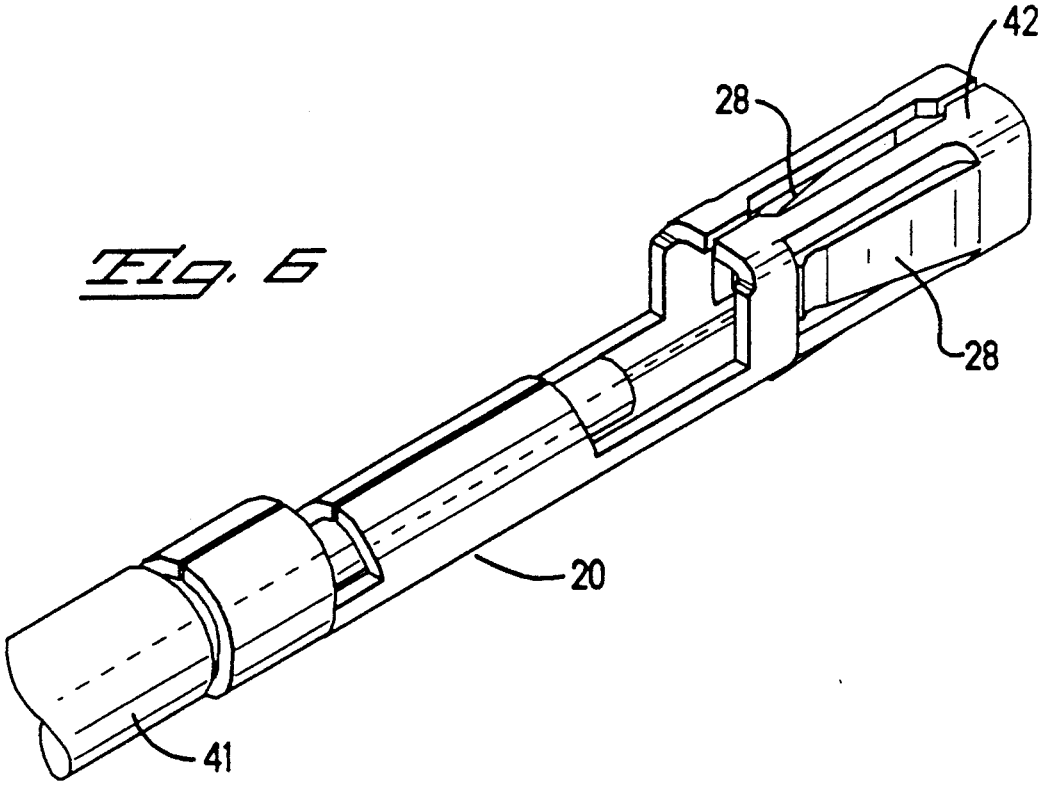
FIG. 6: is a perspective view of a preferred low frequency cable contact.

With reference to FIG. 6, a preferred signal wire mating contact, such as a low frequency cable contact 20 will now be described. The mating contact of the wire 41 preferably includes a box form electrical receptacle 42, including twin fingers 28 for frictionally receiving conductive pins of a field of pins arranged in a grid distribution on a circuit board.

Figure 7:
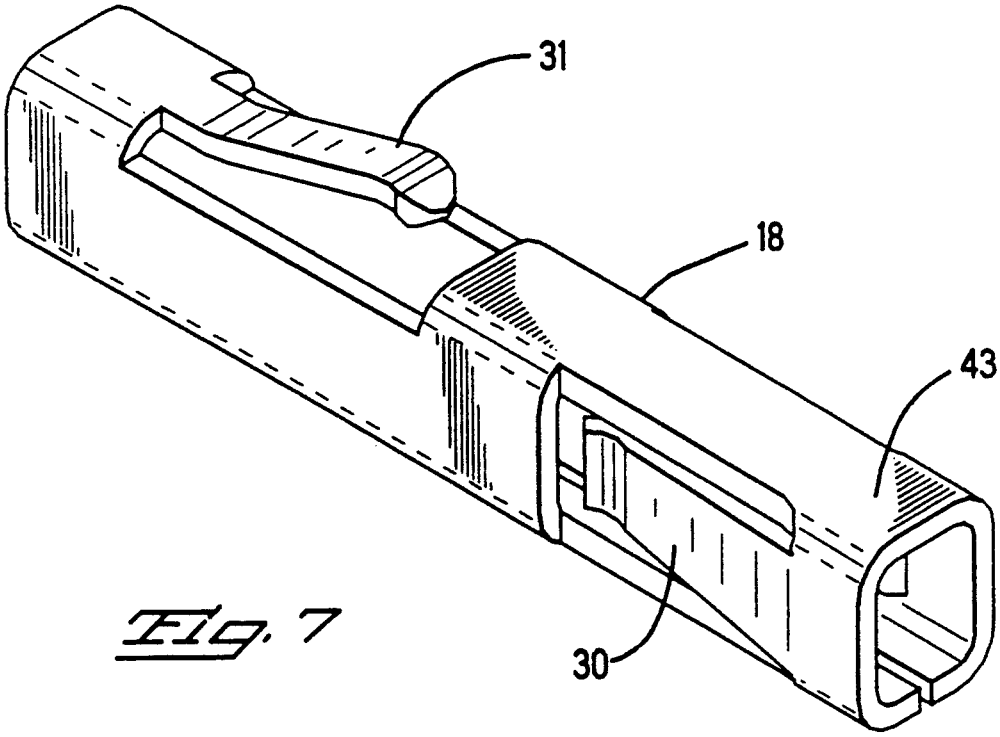
FIG. 7: is a perspective view of a preferred electrostatic discharge grounding contact.

With reference to FIG. 7, a preferred reference contact, such as an electrostatic discharge (ESD) grounding contact 18, is described. The ESD grounding contact 18 preferably provides a ground or reference voltage through the metal can 24 or other contact conducting surface of the differential pair electrical assembly 22 through to a matching contact on the printed circuit board or other target contact surface. The ESD grounding contact 18 includes a grounding spring having opposed twin fingers 30, only one of which is readily seen in FIG. 7, for frictionally receiving conductive pins of, for example, a pin field connector, and a contact finger 31 that enters the transverse opening or slot through the side wall of one of the smaller cavities 14 or 16 for electrically communicating with the metal shell or can 24. As with the low frequency cable contact 20 described above, the ESD grounding contact 18 can also comprise a box form electrical receptacle 43. Electrical receptacles suitable for mating with contact points on a printed circuit board are well known and disclosed in U.S. Pat. Nos. 3,818,424, Re. 26,646, and Re. 26,837, all of which are incorporated herein by reference.

Figure 3:
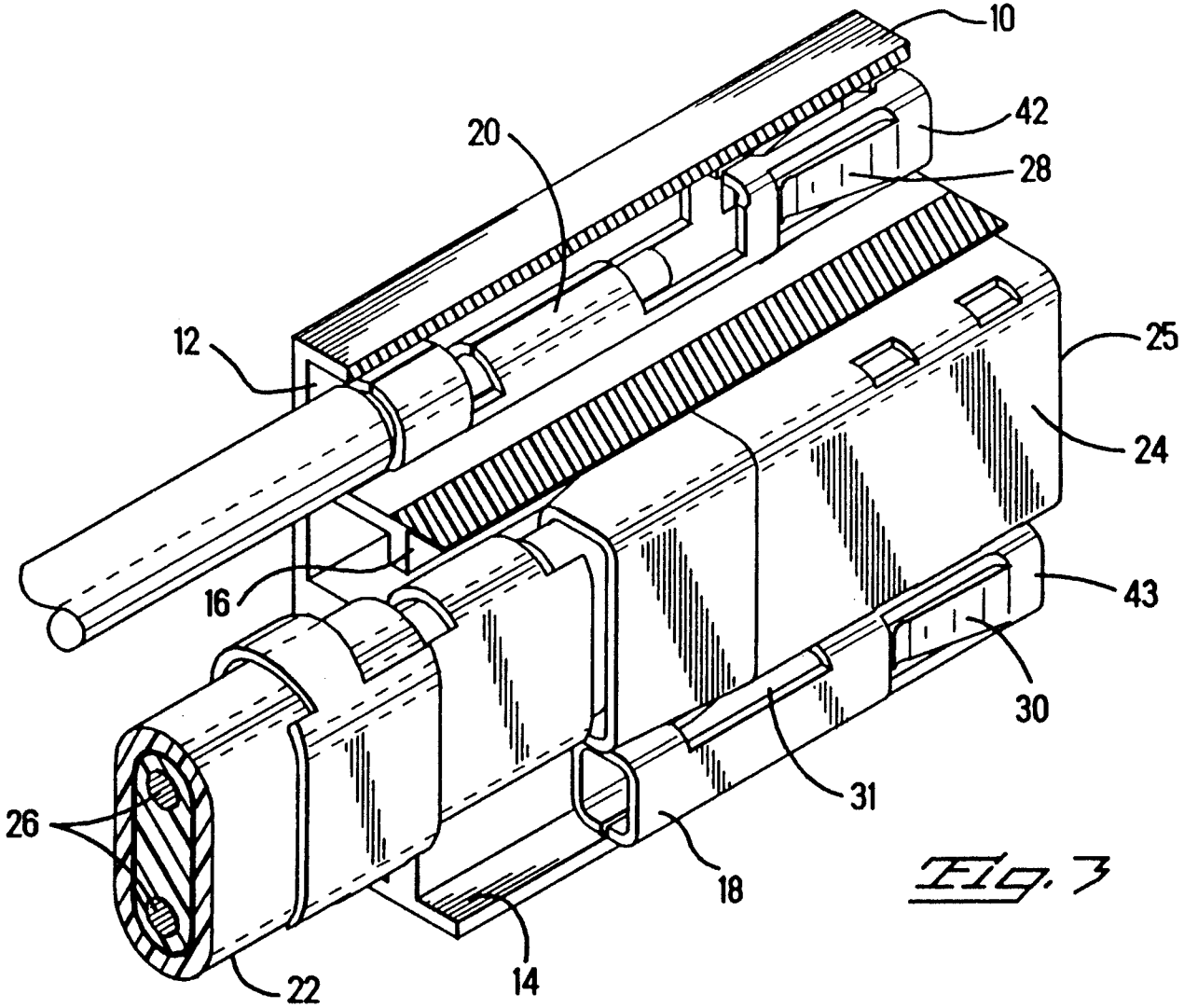
FIG. 3: is a perspective, cross-sectional view of the preferred cable connector illustrating a low frequency cable contact, a differential pair electrical cable assembly, and an electrostatic discharge grounding contact disposed within respective cable-receiving cavities of said housing block.
Figure 4:
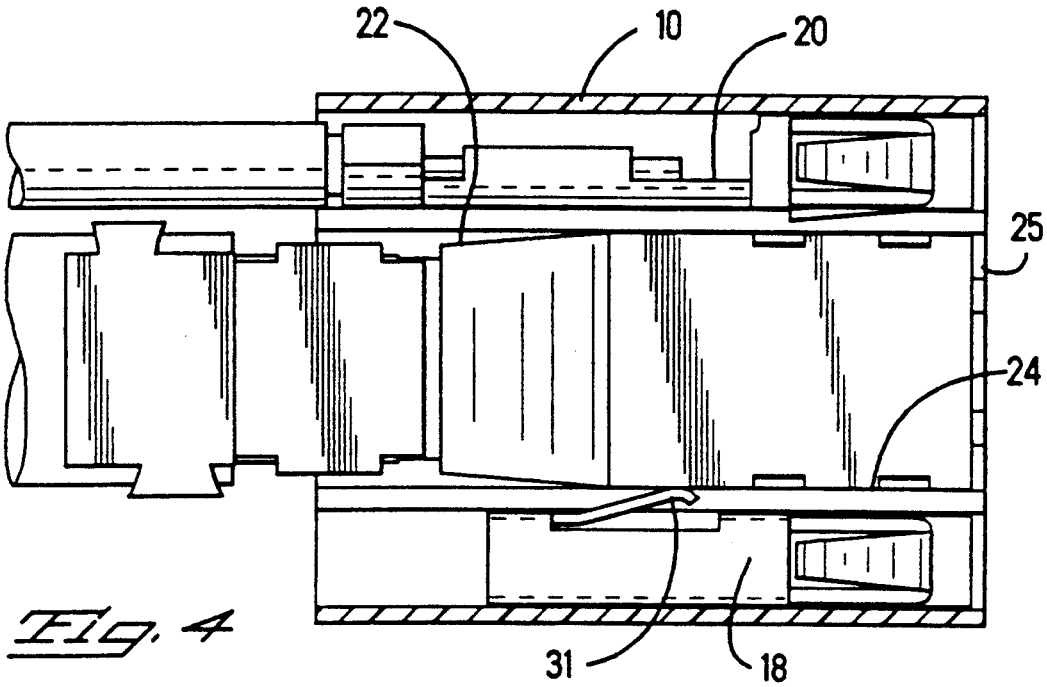
FIG. 4: is a side, cross-sectional view of the cable connector arrangement of FIG. 3.

With reference to FIGS. 3 and 4, upon inserting the preferred plug adapter 25 for the differential pair into the central cavity 16, and the ESD grounding contact 18 into its respective smaller cavity 14, the contact finger 31 pushes through the transverse opening to frictionally contact the can 24 of the plug adapter 25. This permits the ESD grounding contact 18 to electrically join a contact of a suitable pin connector unit to a desired reference electrical potential through the can 24 and conductive braided strip 33 of the differential pair electrical assembly 22. The reference electrical potential can be electrical ground voltage, or a voltage other than ground.

In one important aspect of this invention, the smaller cavities 14, 12, and 15 are preferably of similar cross-sectional areas for providing interchangeability between various contact elements, such as the preferred ESD grounding contact 18 and low frequency cable contact 20. In the preferred embodiments shown in FIGS. 6 and 7, the box form electrical receptacles 42 and 43 are designed to have the substantially same cross sectional area, so that when a low frequency cable contact 20 is replaced with an ESD grounding 18, the contacts remain snug and secure within the housing 10.

In this fashion, various signal/ground patterns can be developed for minimizing electrostatic and electromagnetic interferences. For example, as shown in FIG. 2, a plurality of low frequency cables 41 can be alternated with electrostatic discharge grounding contacts 18 for minimizing cross-talk between pairs of low frequency cables 41. If an end user requires more cables in a particular application, a select number of the grounding springs 18 can be replaced with low frequency cables contacts 20 in a matter of seconds. The preferred 4×5 modular block described in the figures can accommodate two differential pair cables, up to 14 low frequency cables and up to 15 ground contacts, and preferably comprises about 2–10 smaller cavities having transverse slots.

From the foregoing, it can be realized that this invention provides improved cable connectors and housing blocks suitable for providing various signal cable and ground designs, while simultaneously utilizing preferred shielded differential contacts. Although various embodiments have been illustrated, this was for the purpose of describing and not limiting the invention. Various modifications and embodiments, which will become apparent to one skilled in the art, are within the scope of this invention described in the attached claims.

What is claimed is:

1. A cable connector, comprising: an insulating housing block comprising first and second contact-receiving cavities disposed therethrough and at least one transverse opening for communicating between said first and second cavities;

an electrical cable assembly having at least two insulated signal wires;

a conductive shell co-axially disposed around a portion of said electrical cable assembly, said electrical cable assembly and said conductive shell disposed in said first contact-receiving cavity; and a reference contact disposed in said second cable-receiving cavity, said reference contact including a contact finger frictionally contacting said conductive shell through said transverse opening between said first and second cavities.

2. The cable connector of claim 1, wherein said insulating housing block comprises a polymeric modular block.

3. The cable connector of claim 2, wherein said modular block comprises about 10–50 cavities.

4. The cable connector of claim 2, wherein said modular block comprises a 4×5 cavity structure.

5. The cable connector of claim 1, wherein said electrical cable assembly comprises a differential pair cable.

6. The cable connector of claim 5, wherein said differential pair cable comprises a braided, PIC termination and insulation strain relief.

7. The cable connector of claim 1, wherein said conductive shell comprises an electrostatic shielding can.

8. The cable connector of claim 1, wherein said ground contact comprises an electrostatic discharge grounding spring.

9. The cable connector of claim 1, wherein said insulating housing block comprises a third cable-receiving cavity, and said connector further comprises a signal wire having a mating contact disposed within said third cable-receiving cavity.

10. The cable connector of claim 9, wherein said signal wire contact and said ground contact are sized to substantially fit interchangeably within said second and third cable-receiving cavities.

11. A cable connector, comprising:

an insulating housing block comprising at least three contact-receiving cavities disposed therethrough and at least one transverse opening for communicating between a first and a second of said cavities;

a differential pair cable assembly including a corresponding signal contact adapter disposed within said first contact-receiving cavity, said assembly having at least two insulated signal wires, said assembly comprising a conductive shell co-axially disposed around a portion of said signal wires and insulated therefrom;

a reference contact disposed within said second cavity and including a contact finger frictionally contacting said conductive shell of said assembly through said transverse opening; and a signal wire having a mating contact disposed thereon, said mating contact disposed in a third of said contact-receiving cavities of said housing block;

wherein said signal wire mating contact and said reference contact are substantially sized to frictionally fit interchangeably within said second and third cavities.

12. The cable connector of claim 11, wherein said signal wire mating contact comprises a low frequency crimp-snap contact.

13. The cable connector of claim 11, wherein said insulating housing block comprises about 2–10 smaller cross-section, cable-receiving cavities, wherein each of said smaller cross-section cavities includes at least one transverse opening through a wall of said block for communicating with said first cable-receiving cavity.

14. The cable connector of claim 11, wherein said insulating housing block comprises at least a fourth cable-receiving cavity sized to accommodate a differential pair cable assembly.

15. The cable connector of claim 14, wherein said first and fourth cable-receiving cavities are spaced by at least a fifth cable-receiving cavity having a smaller cross-sectional area and a transverse slot communicating with both of said first and fourth cavities.

16. The cable connector of claim 11, wherein said reference contact comprises a twin beam box contact, and said contact finger comprises an active contact beam.

17. The cable connector of claim 16, wherein said first and fourth cavities are centrally located in said housing block for receiving a pair of differential pair cable assemblies, said block further comprising at least ten additional smaller cable-receiving cavities disposed around said first and fourth cavities.

18. A cable connector, comprising an insulating housing block comprising multiple contact-receiving cavities disposed therethrough, including a pair of centrally-located cavities for receiving a pair of differential pair electrical cable assemblies, and a plurality of smaller cavities disposed around said central cavities, at least a first of said smaller cavities having a transverse opening for communicating with a first of said central cavities;

a differential pair electrical cable assembly having at least two insulated signal wires and a conductive metallic braid co-axially disposed around said insulated signal wires, said differential pair electrical cable assembly terminated with a signal contact adapter containing a conductive metallic can electrically connected to said braid, said adapter disposed in said first centrally-located cavity;

a low frequency cable contact disposed in a second of said smaller cavities; and an electrostatic discharge grounding contact disposed in at least said first smaller cavity, said grounding contact comprising a contact finger for frictionally contacting said conductive metallic can of said signal contact adapter through said transverse opening;

wherein said low frequency cable contact and said electrostatic discharge grounding contact comprise a similar cross-sectional shape for fitting interchangeably within said first and second smaller cavities.

19. The cable connector of claim 18, wherein said plurality of smaller cavities comprises at least six low frequency crimp-snap contacts, and at least six electrostatic discharge grounding contacts disposed therein, said low frequency crimp-snap contacts and said electrostatic discharge grounding contacts having similar cross-sections.

20. The cable connector of claim 19, wherein said low frequency crimp-snap contacts and said electrostatic discharge grounding contacts are alternatingly disposed within said smaller cavities.

21. An insulating, cable connector housing block comprising multiple cable-receiving cavities disposed therethrough, including at least one centrally-located cavity for receiving a differential pair electrical cable assembly, and a plurality of smaller cavities of similar cross-sectional shape disposed around said central cavity for alternatingly receiving a low frequency cable, an electrostatic discharge grounding contact, or the like, at least a first of said smaller cavities having a transverse opening for communicating with said centrally-located cavity.

* * * * *